US010538896B2

(12) United States Patent
Trotnow et al.

(10) Patent No.: US 10,538,896 B2
(45) Date of Patent: Jan. 21, 2020

(54) HOIST DRUM FOR POWER SHOVEL

(71) Applicant: Caterpillar Global Mining LLC, Oak Creek, WI (US)

(72) Inventors: Jason J. Trotnow, West Allis, WI (US); Gurbachan S. Bumraw, Franklin, WI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 316 days.

(21) Appl. No.: 14/634,292

(22) Filed: Feb. 27, 2015

(65) Prior Publication Data

US 2016/0251822 A1 Sep. 1, 2016

(51) Int. Cl.

| | |
|---|---|
| ***E02F 3/42*** | (2006.01) |
| ***E02F 3/30*** | (2006.01) |
| *B66D 1/34* | (2006.01) |

(52) U.S. Cl.

CPC ..... *E02F 3/425* (2013.01); *E02F 3/30* (2013.01); *B66D 1/34* (2013.01)

(58) Field of Classification Search

CPC .... E02F 3/58; E02F 3/425; E02F 3/30; B66D 1/34; B66D 1/36; B66D 1/60

USPC ..... D34/35

See application file for complete search history.

(56) References Cited

U.S. PATENT DOCUMENTS 1,437,987 A * 12/1922 Miller ..... B66D 1/34 242/587.1
1,461,052 A * 7/1923 Simpson ..... B66D 1/34 242/587.1
1,767,938 A * 6/1930 Monnier ..... B66D 1/34 242/388.5
1,913,508 A * 6/1933 Phillips ..... B66D 1/34 242/587.1
2,329,943 A * 9/1943 Robins ..... B66D 1/34 242/587.1
2,374,111 A * 4/1945 Le Tourneau ..... B65H 75/28 242/125.1
2,385,906 A * 10/1945 Zeilman ..... E02F 9/2016 192/84.1
2,565,791 A * 8/1951 Wagner ..... B66D 1/14 188/264 D
2,584,099 A * 1/1952 Harkrader ..... B66D 1/34 242/125.1
2,716,691 A * 8/1955 Bowman ..... B23K 9/0253 219/60 R (Continued)

FOREIGN PATENT DOCUMENTS

| | | |
|---|---|---|
| DE | 102005004816 | 2/2005 |
| GB | 858414 | 1/1961 |
| WO | WO 200353821 | 12/2001 |

OTHER PUBLICATIONS

U.S. Design Application entitled "Anchor Hoist Drum" by Jason J. Trotnow filed on Feb. 27, 2015.

*Primary Examiner* — Jessica H Lutz
(74) *Attorney, Agent, or Firm* — Finnegan, Henderson, Farabow, Garrett & Dunner, LLP

(57) ABSTRACT

A hoist drum is disclosed for use with a power shovel. The hoist drum may have a body that is hollow and generally cylindrical, and an anchor connected to an outer annular surface of the body. The hoist drum may also have at least one stiffener located inside the body and extending in an axial direction of the body across the anchor.

19 Claims, 3 Drawing Sheets

(56) References Cited

U.S. PATENT DOCUMENTS 2,860,006 A * 11/1958 Schonrock ..... B60P 1/14 242/587.1
2,872,130 A 2/1959 Nardone
3,582,011 A * 6/1971 Murray ..... B21C 47/323 242/125.1
4,161,126 A * 7/1979 Winzeler ..... B66D 1/22 254/344
4,832,392 A * 5/1989 Butler ..... B66C 1/12 294/82.12
5,312,061 A * 5/1994 McCormick ..... B65H 75/28 242/586.2
7,108,248 B2 * 9/2006 Winter ..... B66D 1/34 242/579
7,490,790 B1 * 2/2009 Gruber ..... A01K 89/01931 242/322
7,513,452 B2 * 4/2009 Ruan ..... B66D 1/34 242/125.1
9,067,250 B2 * 6/2015 Halsey ..... B21D 11/06
9,120,656 B2 * 9/2015 Yoder ..... B66D 1/34
9,764,783 B2 * 9/2017 Corral Rodriguez .... B66D 1/34
2002/0104918 A1 * 8/2002 Zacharias ..... B66D 1/34 242/587.1
2005/0224775 A1 * 10/2005 Ruan ..... B66D 1/34 254/372
2013/0259621 A1 10/2013 Wurster et al.
2013/0284852 A1 10/2013 Fuller et al.
2013/0334479 A1 * 12/2013 Yoder ..... B66D 1/34 254/266
2014/0027691 A1 1/2014 Ilaka et al.
2014/0069758 A1 3/2014 Tojima et al.
2014/0157634 A1 6/2014 Fix et al.
2014/0166952 A1 * 6/2014 Heinrichs ..... B66D 1/34 254/266
2015/0008381 A1 1/2015 Hausladen et al.
2015/0097148 A1 * 4/2015 Wiley ..... B66D 1/34 254/266
2017/0349415 A1 * 12/2017 Kinjarapu ..... E02F 3/36

* cited by examiner

HOIST DRUM FOR POWER SHOVEL

TECHNICAL FIELD

The present disclosure is directed to a hoist drum and, more particularly, to a hoist drum for a power shovel.

BACKGROUND

Power shovels are in a category of excavation equipment used to remove large amounts of overburden and ore during a mining operation. One type of power shovel is known as a rope shovel. A rope shovel includes a boom, a dipper handle pivotally connected to a mid-point of the boom, and a shovel bucket (also known as a dipper) pivotally connected to one end of the dipper handle. Cables or wire ropes extend from a hoist drum over a pulley at a distal end of the boom to an end of the dipper handle supporting the dipper. The ropes are reeled in or spooled out by electric, hydraulic, and/or mechanical motors connected to the hoist drum to selectively raise and lower the dipper.

In most rope shovels, the ropes are connected to the hoist drum by way of anchors mounted to an outer surface of the drum. In particular, a cylindrical collar or ferrule is brazed to an end of each rope, the anchors are welded around their perimeters to the outer surface of the drum, and the ferrule of each rope is placed within a corresponding anchor. The ropes extend through the anchors to wrap tangentially around the drum. An exemplary hoist drum is disclosed in DE Patent 10 2005 004 0816 that issued to Schneider et al. on Aug. 10, 2006.

Although a typical hoist drum may be acceptable in some applications, the weld seams around the anchors can crack and fail in other applications. In addition, the tangential trajectories of the ropes at the anchors can allow the ropes to pivot relative to the drum, and pivoting of the ropes has been shown to cause premature wear. Finally, it may be possible in high-load applications for the drum to crush at the anchor sites and/or for welded seams at ends of the drum to crack. Because the welded seams are internal seams, they can be difficult to inspect or repair.

The internal hoist drum of the present disclosure solves one or more of the problems set forth above.

SUMMARY

In one aspect, the present disclosure is directed to a hoist drum. The hoist drum may include a body that is hollow and generally cylindrical, and an anchor connected to an outer annular surface of the body. The hoist drum may also include at least one stiffener located inside the body and extending in an axial direction of the body across the anchor.

In another aspect, the present disclosure is directed to another hoist drum. This hoist drum may include a body that is hollow and generally cylindrical. The hoist drum may also include an end casting located at an end of the body and having a hub extending outward in an axial direction from a center thereof. The hoist drum may further include an outer annular weld seam connecting the end casting to the body.

In yet another aspect, the present disclosure is directed to a power shovel. The power shovel may include a machine body, a boom pivotally connected at a base end to the machine body, a dipper handle pivotally connected at a midpoint of the boom, and a dipper pivotally connected to a distal end of the dipper handle. The power shovel may also include a cable extending over a distal end of the boom to connect to the distal end of the dipper handle, and an internal hoist drum connected to the machine body and configured to reel in the cable. The internal hoist drum may have a drum body that is hollow and generally cylindrical, and an anchor recessed within an outer annular surface of the drum body. The anchor may include a flat bottom surface that is non-tangential with the outer annular surface. The internal hoist drum may further have at least one stiffener located inside the drum body and extending in an axial direction of the drum body across the anchor, and a plurality of annular grooves formed within the outer annular surface of the drum body. The internal hoist drum may additionally include an end casting connected to an end of the drum body by way of an outer annular weld seam and having a hub extending outward an axial direction from a center thereof, and a flange formed at an end of the drum body opposite the end casting and extending radially outward.

DETAILED DESCRIPTION

Figure 1:
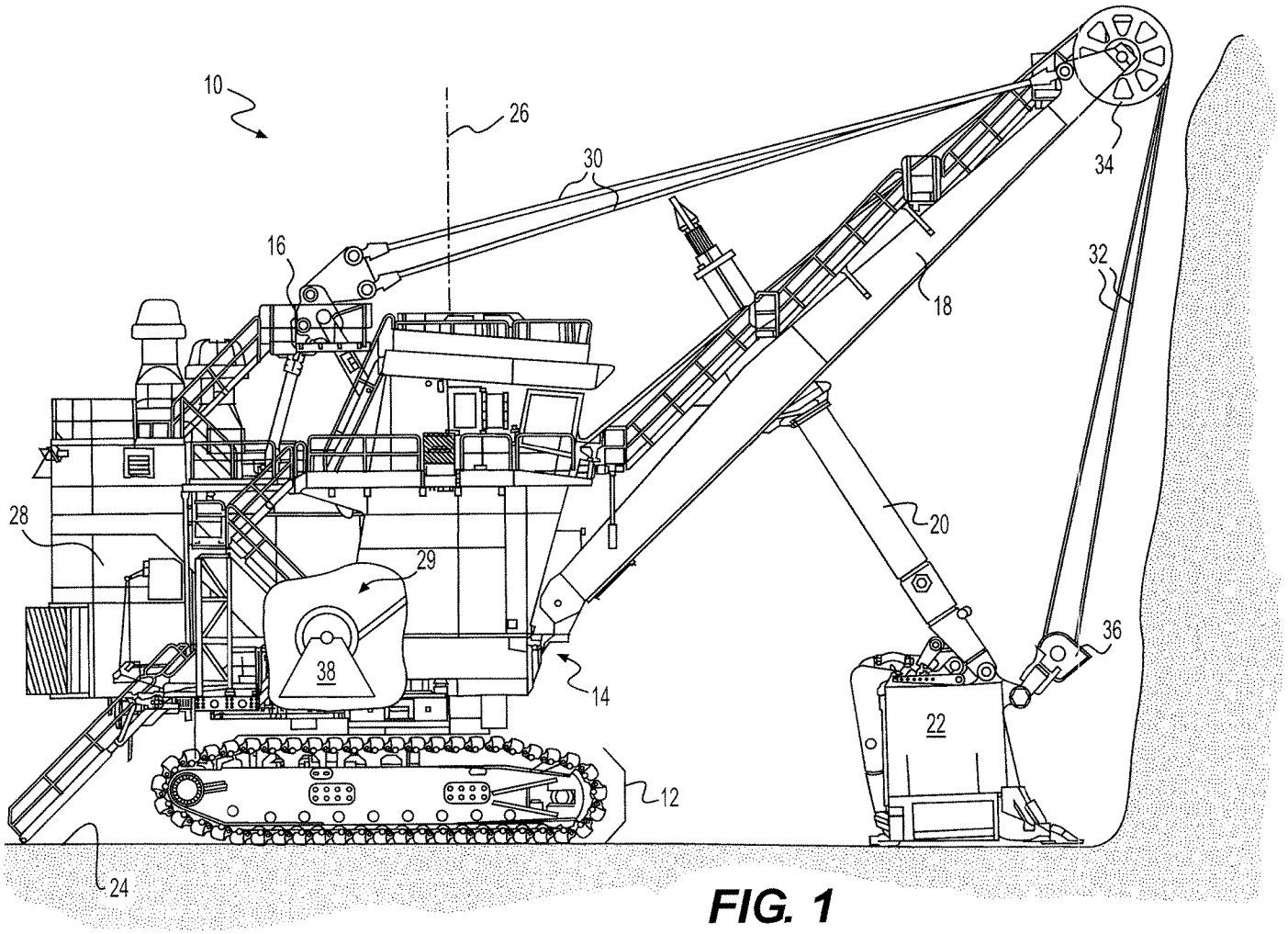
FIG. 1 is a diagrammatic illustration of an exemplary disclosed machine.

FIG. 1 illustrates an exemplary embodiment of a machine 10. Machine 10 may perform some type of operation associated with an industry such as mining, construction, or any other industry known in the art. For example, machine 10 may embody an earth moving machine such as the power shovel (also known as a rope shovel) depicted in FIG. 1. As a power shovel, machine 10 may include a crawler 12, a frame 14 operatively connected to crawler 12, a gantry (also known as an A-frame) 16 rigidly mounted to a top side of frame 14 opposite crawler 12, a boom 18 pivotally connected to a leading end of frame 14, a dipper handle 20 pivotally connected to a midpoint of boom 18, a tool (e.g., a dipper or shovel bucket) 22 pivotally connected to a distal end of dipper handle 20, and cabling connecting gantry 16 to boom 18.

Crawler 12 may be a structural unit that supports movements of machine 10. In the disclosed exemplary application, crawler 12 is itself movable, having one or more traction devices such as feet, tracks, and/or wheels that are driven to propel machine 10 over a work surface 24. In other applications, however, crawler 12 may be a stationary platform configured for direct engagement with work surface 24.

Frame 14 may pivot relative to crawler 12 about a vertical axis 26. As frame 14 is pivoted about axis 26, attached gantry 16, boom 18, dipper handle 20, and tool 22 may likewise pivot to change a radial engagement angle of tool 22 with work surface 24. In the exemplary embodiment of FIG. 1, tool 22 typically engages with a vertical face of work surface 24, and a horizontal face of work surface 24 may be formed as a result of such engagement. The horizontal face of work surface 24 may be removed by tool 22 in subsequent passes and/or by additional machines located proximate work surface 24. Frame 14 may house, among other things, a power source (e.g., a combustion engine) 28 and an internal hoist drum ("drum") 29 that is driven by power source 28.

Gantry 16 may be a structural frame, for example a general A-shaped frame, which is configured to anchor one or more static cables 30 to frame 14. Gantry 16 may extend from frame 14 in a vertical direction away from crawler 12. Gantry 16 may be located rearward of boom 18 relative to tool 22 and, in the disclosed exemplary embodiment, fixed in a single orientation and position. Cables 30 may extend from an apex of gantry 16 to a distal end of boom 18, thereby transferring a weight of boom 18, tool 22, and a load contained within tool 22 into frame 14.

Boom 18 may be pivotally connected at a base end to frame 14, and constrained at a desired vertical angle relative to work surface 24 by cables 30. Additional cables or wire ropes ("ropes") 32 may extend from hoist drum 29 over a pulley mechanism 34 located at the distal end of boom 18 and around a pulley mechanism 36 of tool 22. Ropes 32 may be dynamic, and selectively reeled-in and spooled-out by hoist drum 29 to affect the height and angle of tool 22 relative to work surface 24. For example, when ropes 32 are reeled in, the decreasing effective length of ropes 32 may cause tool 22 to rise and tilt backward away from work surface 24. In contrast, when ropes 32 are spooled out, the increasing effective length of ropes 32 may cause tool 22 to lower and tilt forward toward work surface 24.

Dipper handle 20 may be pivotally connected at one end to a general midpoint of boom 18, and at an opposing end to a corner of tool 22 adjacent pulley mechanism 36 (e.g., rearward of pulley mechanism 36). In this position, dipper handle 20 may function to maintain a desired distance of tool 22 away from boom 18 and ensure that tool 22 moves through a desired arc as ropes 32 are reeled in and spooled out. In the disclosed embodiment, dipper handle 20 may be connected to boom 18 at a location closer to the base end of boom 18, although other configurations are also possible. In some configurations, dipper handle 20 may be provided with a crowd cylinder (not shown) that functions to extend or retract dipper handle 20. In this manner, the distance between tool 22 and boom 18 (as well as the arcuate trajectory of tool 22) may be adjusted.

Figure 2:
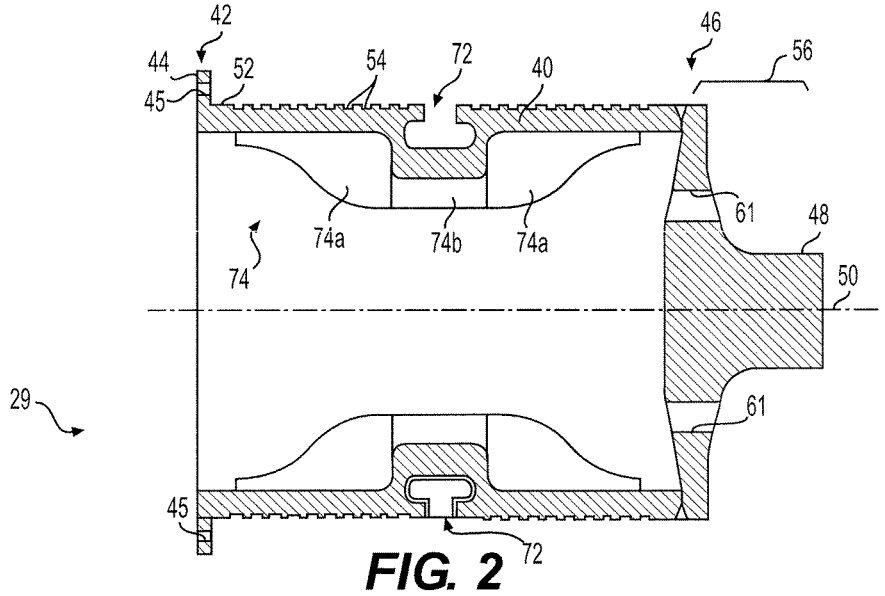
FIG. 2 is a cross-sectional illustration of an exemplary disclosed hoist drum that may be used in conjunction with the machine of FIG. 1.
Figure 3:
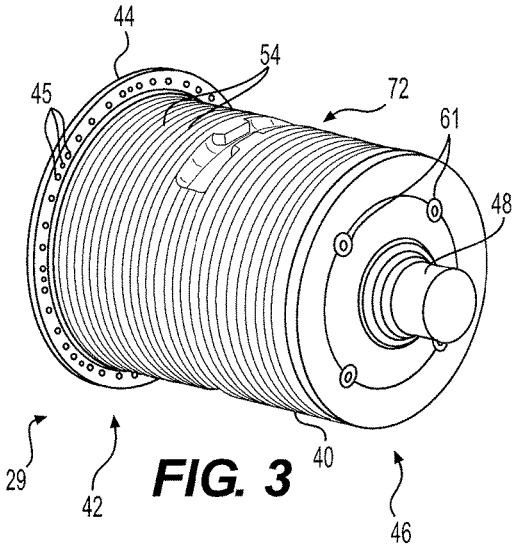
FIGS. 3 and 4 are isometric illustrations of the hoist drum of FIG. 2.
Figure 4:
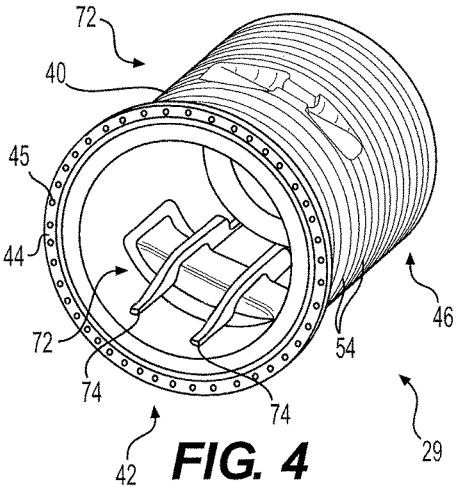

Drum 29 may be rotatably mounted within a pedestal 38 that is fixedly connected to frame 14, and operatively connected to power source 28 via a gear train (not shown). As shown in FIGS. 2-4, drum 29 may include a body 40 that is generally cylindrical and hollow. In the disclosed embodiment, body 40 is a forged component, although a cast or rolled component may also be used. A first end 42 of body 40 may be connected (e.g., bolted) to a component (e.g., to a spider) of the gear train and function as an input end that receives torque sufficient to reel-in and spool-out ropes 32 (referring to FIG. 1). A flange 44 may be located at first end 42 to facilitate connection to the gear train via the spider. Flange 44 may be welded to or integrally formed with body 40, as desired, and a plurality of holes 45 may be formed therein to facilitate connection to the spider. A second and opposing end 46 of body 40 may include a hub f48 that rests inside a bearing of pedestal 38. Body 40 may have a central axis 50 that passes through flange 44 and hub 48, and an outer annular surface 52. A plurality of annular cable grooves 54 may be formed within outer annular surface 52. Grooves 54 may spiral around body 40 and be configured to receive and guide ropes 32 (referring to FIG. 1).

Hub 48 may be an integral part of an end casting 56 that is welded to body 40. In particular, end casting 56 may have an outer diameter that is about the same (e.g., within manufacturing tolerances) as an outer diameter of annular surface 52 of body 40, and end casting 56 may butt up against end 46 of body 40. Adjacent edges of annular surface 52 and end casting 56 may be beveled away from each other to create a v-shaped channel 58 (see FIG. 5—grooves 54 omitted for clarity) that is subsequently filled with molten material during fabrication to create a weld seam 60. In this configuration, outer annular surface 52, an outer edge of end casting 56, and weld seam 60 may create a substantially continuous surface. Hub 48 may extend axially outward from a center of end casting 56, and one or more lifting lugs 61 (e.g., four equally distributed lifting lugs 61) may be located with an external face of end casting 56 and radially outward of hub 48.

At least one anchor 72 may be recessed within outer annular surface 52 of drum body 40 to receive one or more ends of ropes 32. In the disclosed example, two anchors 72 are included and each is configured to receive two cable ends (e.g., in opposition to each other). It is contemplated that fewer or more anchors 72 may be included, if desired, and each dedicated to holding any number of cable ends. Anchor(s) 72 may be generally centered in an axial direction of body 40 and, if more than one anchor 72 is included, anchors 72 may be located symmetrically around the periphery of body 40 to improve the balance of drum 29. For example, when two anchors 72 are included, anchors 72 may be located opposite each other relative to body 40.

One or more stiffeners 74 (see FIGS. 2 and 4) may be associated with each anchor 72. In the disclosed example, two stiffeners 74 are associated with each anchor 72 and spaced apart from each other in a radial direction. Stiffeners 74 may be plate-like, have a length direction aligned with an axial direction of drum 29, be located inside body 40, and extend across anchor 72. Stiffeners 74 may take any desired form. In one embodiment, each stiffener 74 is comprised of three components, including two side gussets 74*a* (one located at each axial end of the associated anchor 72), and a center web 74*b* that extends between gussets 74*a*. Each of these components may be welded to each other (e.g., end-to-end) to form stiffener 74, and gussets 74*a* may additionally be welded along their lengths to interior surfaces of body 40 and anchor 72. In the disclosed embodiment, center web 74*b* is integral with anchor 72 (e.g., extends radially inward from an inner-most surface of anchor 72). However, it is contemplated that center web 74*b* could alternatively be a standalone component or that gussets 74*a* and center web 74*b* could form portions of a single-piece integral component, if desired.

Figure 5:
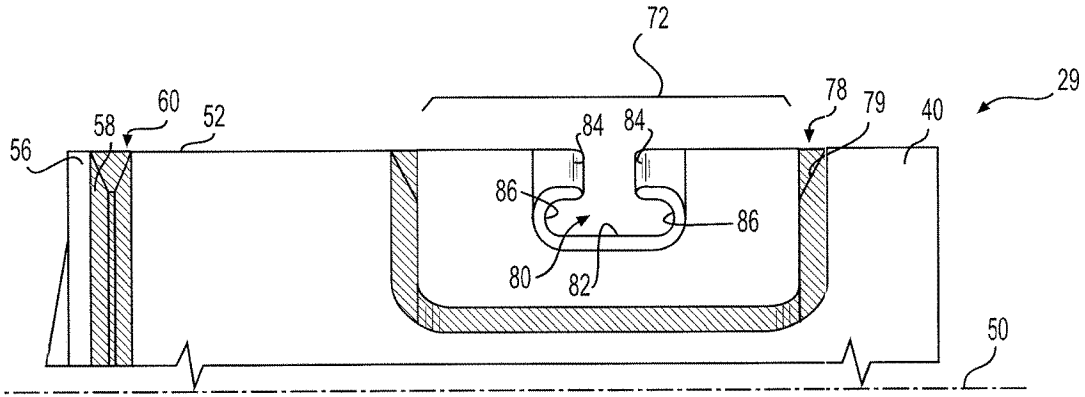
FIG. 5 is an enlarged portion of the hoist drum of FIGS. 2-4 showing an exemplary anchor.
Figure 6:
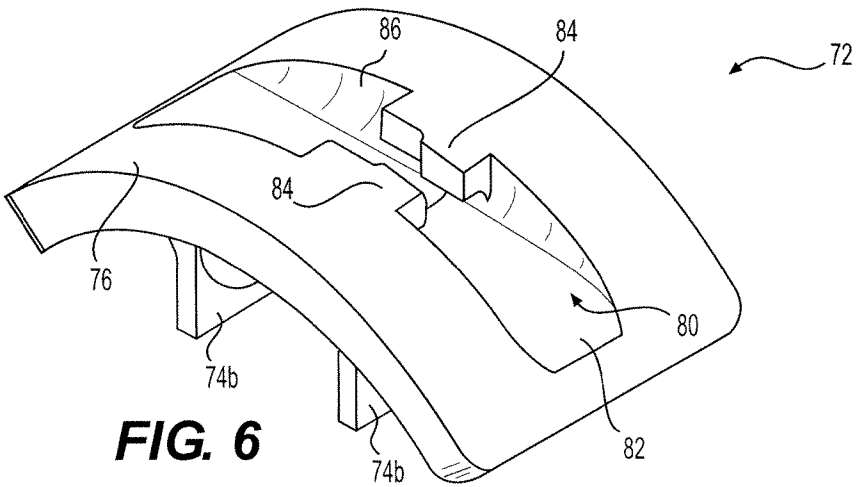
FIG. 6 is an isometric illustration of the anchor of FIG. 5.

Anchor 72 may be a cast component that is subsequently welded into a corresponding hole or recess in body 40. As shown in FIGS. 5 and 6, anchor 72 may have an arcuate outer surface 76 that is substantially concentric and parallel with outer annular surface 52 of body 40 when fabrication of drum 29 is complete. In fact, weld seams 78 that surround a periphery of anchor 72 and connect anchor 72 to body 40 may be generally continuous (i.e., within manufacturing tolerances) with arcuate outer surface 76 and annular surface 52. Body 40 and/or anchor 72 may be beveled at weld seams 78 so as to create a channel 79 that receives weld seams 78.

Anchor 72 may have a longitudinal pocket 80 recessed within arcuate outer surface 76. Pocket 80 may have a flat bottom surface 82 and extend in the length direction about 5-6 times an extension distance in the width direction. Bottom surface 82 may be oriented generally perpendicular to axis 50 and non-tangential to outer annular surface 52 of drum body 40. The non-tangential configuration may cause the associated ropes 32 to arch out over an end of bottom surface 82 before lying on outer annular surface 52, the arching functioning to inhibit rotation of ropes 32 relative to body 40. One or more retainers or fingers 84 may extend axially inward from arcuate outer surface 76 a distance over bottom surface 82 to retain the associated cable ends (e.g., to retain ferrules that have been brazed to the rope ends—not shown) inside pocket 80, and retainers 84 may function as end-stops or collars for the ferrules. That is, retainers 84 may be spaced radially away from bottom surface 82 to form a ceiling of pocket 80. In the disclosed embodiment, two retainers 84 are included in each anchor 72 and centered relative to the length direction of bottom surface 82. Side walls 86 of pocket 80 may be curved outward (e.g., concave) such that a cross-sectional shape of anchor 72 through pocket 80 may be oval (See FIGS. 2 and 5).

INDUSTRIAL APPLICABILITY

The disclosed hoist drum may be used in any power shovel application where component longevity and reliability are desired. The disclosed hoist drum may have improved longevity due to increased stiffness provided via stiffeners 74 and the unique connection configuration of end casting 56. In addition, because end casting 56 and anchors 72 may be connected to body 40 via external weld seams 60 and 78, inspection of these seams may be easy to perform. For example, ultrasonic testing may be performed by directing ultrasonic vibrations axially through end casting 56 at its periphery, through weld seam 60, and into body 40. In addition, because weld seams 60 and 78 are external, low-cost visual inspections that do not require any tooling or disassembly of hoist drum 29 may be more readily performed. Finally, the non-tangential configuration of anchors 72 may inhibit rotation and the associated premature wear of ropes 32.

It will be apparent to those skilled in the art that various modifications and variations can be made to the disclosed power shovel and hoist drum. Other embodiments will be apparent to those skilled in the art from consideration of the specification and practice of the disclosed power shovel and hoist drum. It is intended that the specification and example be considered as exemplary only, with a true scope being indicated by the following claims and their equivalents.

What is claimed is:

1. A multi-piece hoist drum, comprising:

a body that is hollow and generally cylindrical;

an anchor welded to the body such that a perimeter of the anchor is flush with an outer annular surface of the body, the anchor being configured to retain a cable end portion; and at least one stiffener welded to the anchor and an interior surface of the body and extending in an axial direction of the body across the anchor, wherein:

a weld seam forming an interface between the perimeter of the anchor and the outer annular surface of the body is an external weld seam viewable from outside the multi-piece hoist drum, the body includes an opening to receive the anchor, and a periphery of the body at the opening is beveled to provide for the weld seam between the periphery of the body and the perimeter of the anchor.

2. The multi-piece hoist drum of claim 1, wherein:

the anchor has a length direction and a width direction; and the length direction of the anchor is generally perpendicular to the axial direction of the body.

3. The multi-piece hoist drum of claim 1, wherein the anchor defines a longitudinal pocket that is recessed radially inward relative to the perimeter of the anchor that is flush with the outer annular surface of the body, the pocket being configured to receive and retain the cable end portion.

4. The multi-piece hoist drum of claim 1, wherein the anchor includes:

an outer curved surface that is substantially aligned with the outer annular surface of the body; and a flat bottom surface that is non-tangential with the outer annular surface of the body.

5. The multi-piece hoist drum of claim 4, wherein the anchor further includes at least one retainer that extends axially inward from the outer curved surface over the flat bottom surface, the at least one retainer being radially spaced away from the flat bottom surface to form a space configured to receive a ferrule.

6. The multi-piece hoist drum of claim 5, wherein a cross-section of the space is generally oval.

7. The multi-piece hoist drum of claim 4, wherein a length of the space is about 5-6 times a width of the space.

8. The multi-piece hoist drum of claim 1, wherein the outer annular surface of the body, the curved outer surface of the anchor, and the weld seam are generally continuous.

9. The multi-piece hoist drum of claim 1, further including a plurality of annular grooves formed within the outer annular surface of the body.

10. The multi-piece hoist drum of claim 1, further including:

a flange formed at a first end of the body and extending radially outward; and an end casting connected to an opposing second end of the body and having a hub extending outward in the axial direction from a center thereof.

11. The multi-piece hoist drum of claim 10, wherein the end casting is connected to the generally cylindrical body by way of a second weld seam, such that the outer annular surface, an edge the end casting, and the second weld seam are generally continuous.

12. The multi-piece hoist drum of claim 1, wherein the anchor is axially centered within the body.

13. A multi-piece hoist drum, comprising:

a body that is hollow and generally cylindrical;

an end casting located at an end of the body and having a hub extending outward in an axial direction from a center thereof;

an outer annular weld seam connecting the end casting to the body;

an anchor welded to the body such that an entire perimeter of the anchor is flush with an outer annular surface of the body, the anchor being configured to retain a cable end portion; and at least one stiffener welded to the anchor and an interior surface of the body and extending in the axial direction of the body across the anchor, wherein:

a weld seam forming an interface between the perimeter of the anchor and the outer annular surface of the body is an external weld seam viewable from outside the multi-piece hoist drum, the body includes an opening to receive the anchor, and a periphery of the body at the opening is beveled to provide for the weld seam between the periphery of the body and the perimeter of the anchor.

14. The multi-piece hoist drum of claim 13, wherein the body, an edge of the end casting, and the outer annular weld seam together form the outer annular surface of the body that is generally continuous.

15. The multi-piece hoist drum of claim 14, wherein the edge of the end casting and the body are beveled to provide for the outer annular weld seam.

16. The multi-piece hoist drum of claim 13, further including a plurality of annular grooves formed within the outer annular surface of the body.

17. The multi-piece hoist drum of claim 13, further including a flange connected to the body at an end opposite the end casting and extending radially outward.

18. The multi-piece hoist drum of claim 17, further including at least one lifting lug formed within a face of the end casting.

19. A power shovel, comprising:

a machine frame;

a boom pivotally connected at a base end to the machine frame;

a dipper handle pivotally connected at a midpoint of the boom;

a dipper pivotally connected to a distal end of the dipper handle;

a rope extending over a distal end of the boom to connect to the distal end of the dipper handle; and an internal hoist drum connected to the machine frame and configured to reel in the rope, the internal hoist drum including:

a drum body that is hollow and generally cylindrical;

an anchor recessed within an outer annular surface of the drum body and configured to retain a cable end on an outer surface of the body, the anchor having a flat bottom surface that is non-tangential with the outer annular surface;

at least one stiffener welded to the anchor and an interior surface of the drum body and extending in an axial direction of the drum body across the anchor;

a plurality of annular grooves formed within the outer annular surface of the drum body;

an end casting connected to an end of the drum body by way of an outer annular weld seam and having a hub extending outward in an axial direction from a center thereof; and a flange formed at an end of the drum body opposite the end casting and extending radially outward.

* * * * *